US009316375B2

(12) United States Patent
Hupel et al.

(10) Patent No.: US 9,316,375 B2
(45) Date of Patent: Apr. 19, 2016

(54) VEHICLE LIGHT

(75) Inventors: Martin Hupel, Barcelona (ES); Henning Kiel, Wolfsburg (DE); Sebastian Haering, Wolfsburg (DE); Sebastian Vogler, Wolfsburg (DE)

(73) Assignee: VOLKSWAGEN AG, Wolfsburg (DE)

( * ) Notice: Subject to any disclaimer, the term of this patent is extended or adjusted under 35 U.S.C. 154(b) by 808 days.

(21) Appl. No.: 13/203,569

(22) PCT Filed: Feb. 26, 2010

(86) PCT No.: PCT/EP2010/052507

§ 371 (c)(1), (2), (4) Date: Oct. 25, 2011

(87) PCT Pub. No.: WO2010/097473

PCT Pub. Date: Sep. 2, 2010

(65) Prior Publication Data

US 2012/0039085 A1 Feb. 16, 2012

(30) Foreign Application Priority Data

Feb. 27, 2009 (DE) ..... 10 2009 010 829

(51) Int. Cl.
*F21V 7/00* (2006.01)
*F21S 8/10* (2006.01)
(Continued)

(52) U.S. Cl.
CPC ..... *F21S 48/1364* (2013.01); *F21S 48/137* (2013.01); *F21S 48/1317* (2013.01); *F21S 48/1358* (2013.01); *F21S 48/2212* (2013.01); *F21S 48/23* (2013.01); *F21V 7/04* (2013.01); *F21V 7/09* (2013.01); *F21V 21/26* (2013.01)

(58) Field of Classification Search
CPC ..... F21V 7/09; F21V 7/04; F21S 48/1317; F21S 48/1358; F21S 48/137; F21S 48/1364
USPC ..... 362/516–519, 346–348, 360, 235–236, 362/247–248
See application file for complete search history.

(56) References Cited

U.S. PATENT DOCUMENTS 1,559,930 A * 11/1925 Bean ..... 362/510
1,595,044 A * 8/1926 Cushing et al. ..... 362/247
(Continued)

FOREIGN PATENT DOCUMENTS

CN 1497206 A 5/2004 ..... B60Q 1/26
DE 102006003470 A1 8/2007 ..... F21S 8/12
(Continued)

OTHER PUBLICATIONS

International PCT Search Report, PCT/EP2010/052507, 4 pages, Mailed Jul. 21, 2010.

*Primary Examiner* — Robert May
*Assistant Examiner* — Bryon T Gyllstrom
(74) *Attorney, Agent, or Firm* — Slayden Grubert Beard PLLC

(57) ABSTRACT

A light for a vehicle having a contiguous reflector (3) having a plurality of reflector surface regions (A1, A2, B) and a first light source (1) that is arranged such that the light emission thereof is reflected by a first region (A1, B) of the reflector surface of the reflector (3). The reflector (3) has an opening (5) and there is a second light source that is arranged behind a part (4) of the reflector (3) relative to the light emission direction (L) of the light and the light emission thereof hits a second region (A2) of the reflector surface of the reflector (3) through the opening (5) and is there reflected.

21 Claims, 3 Drawing Sheets

(51) Int. Cl.

| | |
|---|---|
| ***F21V 7/09*** | (2006.01) |
| ***F21V 7/04*** | (2006.01) |
| ***F21V 21/26*** | (2006.01) |

(56) References Cited

U.S. PATENT DOCUMENTS

| | | | | |
|---|---|---|---|---|
| 1,666,151 | A * | 4/1928 | Stiert | 362/245 |
| 1,961,836 | A * | 6/1934 | Warner | 362/517 |
| 2,143,673 | A * | 1/1939 | Baumgartner | 362/303 |
| 7,070,310 | B2 * | 7/2006 | Pond et al. | 362/545 |
| 7,073,928 | B2 * | 7/2006 | Toyofuku | 362/509 |
| 7,118,260 | B2 * | 10/2006 | Tsukamoto et al. | 362/517 |
| 7,134,774 | B2 * | 11/2006 | Iwasaki | 362/517 |
| 7,178,960 | B2 * | 2/2007 | Ishida | 362/545 |
| 7,273,303 | B2 * | 9/2007 | Mochizuki | 362/475 |
| 7,281,833 | B2 * | 10/2007 | Akiyama | 362/545 |
| 7,311,430 | B2 * | 12/2007 | Tsukamoto et al. | 362/545 |
| 2004/0190303 | A1 * | 9/2004 | Mishimagi | B60R 1/1207 362/494 |
| 2012/0039085 | A1 * | 2/2012 | Hupel et al. | 362/518 |

FOREIGN PATENT DOCUMENTS

| | | | | |
|---|---|---|---|---|
| JP | 2002093215 | A | 3/2002 | F21S 8/10 |
| WO | 2010/097473 | A1 | 9/2010 | F21S 8/10 |

* cited by examiner

VEHICLE LIGHT

CROSS-REFERENCE TO RELATED APPLICATIONS

This application is a U.S. National Stage Application of International Application No. PCT/EP2010/052507 filed Feb. 26, 2010, which designates the United States of America, and claims priority to German Application No. 10 2009 010 829.7 filed Feb. 27, 2009, the contents of which are hereby incorporated by reference in their entirety.

TECHNICAL FIELD

The present invention relates to a light for a vehicle having a continuous reflector comprising several reflector face regions and a first light source that is arranged such, that the light emission thereof is reflected by a first region of the reflector face of the reflector.

BACKGROUND

During a redesign of vehicles the problem arises, that due to the desired aerodynamics and the desired design the installation space characteristics for illumination units, in particular for the lights including tail lights and head lights, are dimensioned very tight. However, the signaling effect of a light is determined by the size of the perimeter of the radiating face and by the light density.

Furthermore, the vehicle lights significantly contribute to the design of the vehicle. By means of the forming of the lights, the vehicle often is to be given a characteristic appearance that is easily recognized. In addition, the problem arises, that the cost of manufacturing the lights shall be as low as possible.

SUMMARY

According to various embodiments, a light of the type contemplated above can be provided, which on the one hand gives a characteristic appearance to the vehicle, however, on the other hand may be easily adapted to different installation space characteristics and which finally may be manufactured in a cost-effective manner. In addition, the light density distribution of the luminescent faces is to be as homogeneous as possible.

According to an embodiment, a light for a vehicle, may comprise a continuous reflector comprising several reflector face regions, and a first light source that is arranged such that the light emission thereof is reflected by a first region of the reflector face of the reflector, wherein the reflector has an opening, and a second light source is provided, which is arranged behind a part of the reflector relative to the light emission direction of the light and whose light emission impinges through the opening on a second region of the reflector face of the reflector and is reflected there.

According to a further embodiment, the reflector has an indentation, a part of the reflector formed by the indentation can be curved forward in the light emission direction of the light and the second light source is arranged behind the forward curved part of the reflector. According to a further embodiment, the forward curved part of the reflector can be formed in the form of a shovel. According to a further embodiment, the direct view onto the second light source from the outside can be prevented by the forward curved part of the reflector. the first light source can be arranged at the focal point of the regions of the reflector face of the reflector which reflect the light emission of the first light source and the second light source is arranged at the focal point of the regions of the reflector face of the reflector which reflect the light emission of the second light source. According to a further embodiment, at least one light pane can be provided onto which the light reflected by the reflector faces impinges and at which at least two discontinuous luminescent faces are formed. According to a further embodiment, the at least one light pane may comprise light dispersing elements on the side facing towards the first light source as well as on the side facing away from the first light source. According to a further embodiment, the light dispersing elements may extend in horizontal direction on the side facing away from the first light source. According to a further embodiment, the light dispersing elements on the side facing away from the first light source can be horizontally aligned partial cylinders. According to a further embodiment, the light dispersing elements may extend in vertical direction on the side facing towards the first light source. According to a further embodiment, the at least one light pane or the light dispersing elements of the light pane only can be arranged in the region of the luminescent faces of the light. According to a further embodiment, the first light source can be shielded by a mask that prevents a direct view onto the first light source from the outside. According to a further embodiment, the light may have a housing which is completed by a completion pane in the outlet direction of the light, and the at least one light pane is arranged inside the housing.

BRIEF DESCRIPTION OF THE DRAWINGS

Referring to the drawings, the invention will now be described by means of an exemplary embodiment.

DETAILED DESCRIPTION

Figure 1:
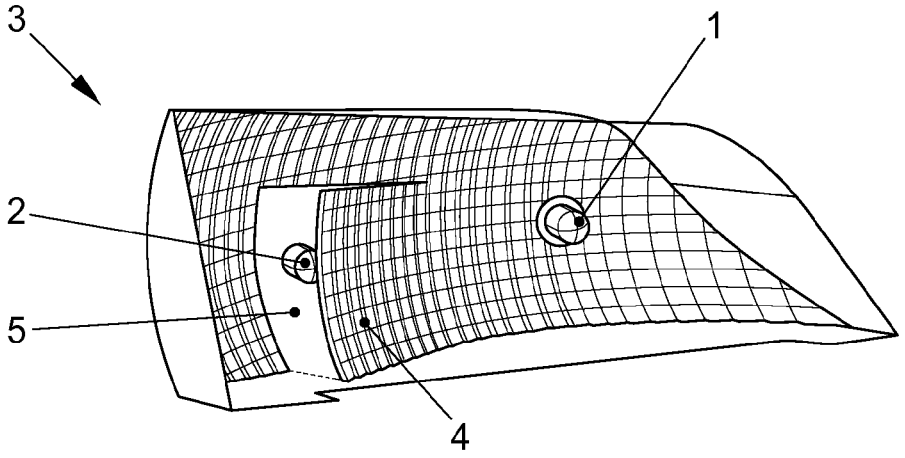
FIG. 1 schematically shows a perspective view of an exemplary embodiment of the light.

The light according to various embodiments, comprises a reflector with an opening and a second light source that is arranged behind a part of the reflector relative to the light emission direction of the light and the light emission thereof impinges on a second region of the reflector face of the reflector through the opening and is reflected there.

Thus, according to various embodiments, a single continuous reflector is provided, which provides several reflector face regions for the light emission of the two light sources. Even though the second light source is arranged behind a part of the reflector in a concealed manner such that this light source is not visible from the outside, the light emission of this light source is reflected by a region of the reflector face of the reflector.

According to an embodiment of the light the reflector has an indentation. The part of the reflector formed by the indentation is curved forward in the direction of the light emission of the light. Arranged behind the forward curved part of the reflector is the second light source. In doing so, the forward curved part of the reflector in particular is formed comprising the shape of a shovel. Formed between the forwardly curved part of the reflector and the remaining part of the reflector is the opening through which passes the light emission of the second light source.

Since no separate reflectors are provided for each light source in the light according to various embodiments, but the light emission is reflected via the reflector faces of the continuous reflector, the light requires very little installation space. Furthermore, the direct view onto the second light source from the outside may be prevented without additional elements such as masks or shields.

According to an embodiment of the light the reflector is formed in one piece.

According to an embodiment of the light the first light source is arranged at the focal point of the regions of the reflector face of the reflector which reflect the light emission of the first light source, and the second light source is arranged at the focal point of the regions of the reflector face of the reflector which reflect the light emission of the second light source. Thereby, understood as the focal point of a reflector face is the position where rays of light emitted therefrom are reflected by the reflector face such that the reflected rays of light are parallel or approximately parallel to each other. Thus, the rays of light emitted by the light sources in this embodiment of the light are reflected by the reflector faces of the reflector such that a light beam consisting of parallel or approximately parallel rays of light is created.

According to an embodiment of the light the light emitted by the light sources directly impinges on the reflector faces of the reflector. Neither optically operative elements, such as lenses, prism or the like, nor transparent panes are arranged between the light sources and the reflector faces.

According to an embodiment of the light at least one light pane is provided. The light reflected by the reflector faces impinges on this light pane. At least two discontinuous luminescent faces are formed at the light pane.

According to a further embodiment of the light the light pane comprises light dispersing elements. In particular on the side facing towards the first light source as well as on the side facing away from the first light source the light pane comprises light dispersing elements. Preferably, on the side facing away from the first light source the light dispersing elements extend in horizontal direction. In particular, they consist of horizontally aligned partial cylinders. Preferably, on the side facing towards the first light source the light dispersing elements extend in vertical direction. In this case as well they may consist of vertically aligned partial cylinders. On the light entering side or the light exiting side, respectively, the cross section of the partial cylinders may have the form of a section of a circle or a section of a parabola or another convex curvature, which essentially results from the desired light dispersion. Thereby, the light dispersing elements on the side facing away from the first light source preferably are formed particularly distinctive. They have a curvature or rounding, respectively, different from the light dispersing elements on the side facing towards the first light source. In particular, the curvature of the horizontally aligned partial cylinders on the side of the light pane facing away from the first light source is smaller than the curvature of the vertically aligned partial cylinders on the side facing towards the first light source. This design results in that the partial cylinders on the outer side are very distinctively visible from the outside.

The light dispersing elements of the light pane arrange for, that the parallel or approximately parallel light impinging from the reflector faces onto the light pane is dispersed into the desired angles. Thereby, the light dispersing elements are formed such that the contour of the light pane on the side visible from the outside corresponds to the aesthetic requirements, i.e. the desired design, whereas the light dispersing elements on the backside, i.e. on the side facing towards the light source, assume the main function of light dispersion, in particular the function of horizontal light dispersion. By means of the side of the light pane visible from the outside thereby a specific light dispersion is created. However, the desired light dispersion only is created by the addition of the light dispersing elements on the side not visible from the outside.

As a further advantage it is resulting from the light according to various embodiments, that the luminescent faces have a very homogeneous distribution of light density. That is to say, the parallel or approximately parallel rays of light created by the reflector faces only are dispersed at the light pane. For this reason it is not possible to identify a light source within a luminescent face. It has arisen in lights according to prior art, in which the light emission of several light sources is used for a luminescent face, that particularly from larger distances regions comprising larger light intensities are formed within a luminescent face. The viewer of these regions comprising larger light intensity can associate them to single light sources.

According to a further embodiment of the light the light pane or the light dispersing elements of the light pane only are arranged in the region of the luminescent faces of the light. The light pane therefore may consist of two separate light panes. Further, also only the light dispersing elements may be provided in these regions, but apart from that the light pane may be continuous.

According to a further embodiment of the light the first light source is shielded by a mask, which prevents a direct view onto the first light source from the outside. This way it is ensured that only the two luminescent faces are observed from the outside and not the light sources themselves.

According to a further embodiment of the light this has a housing, which is completed by a completion pane in the output direction of the light. In this case, the light pane is arranged inside the housing. Thus, it forms an intermediate light pane. Preferably, the completion pane is implemented using the visual effect of clear glass, that is, one can look into the inside of the housing from the outside without a significant interference. Thus, in the switched on state of the light source as well as in the switched off state of the light source the appearance of the light is determined by the intermediate light pane comprising the light dispersing elements on the outside. Formed on the outside of the intermediate light pane are the luminescent faces, which are visible through the completion pane.

According to an embodiment of the light the first luminescent face may have the shape of a disk or a rectangle, and the second luminescent face may have the shape of an angle.

Figure 2:
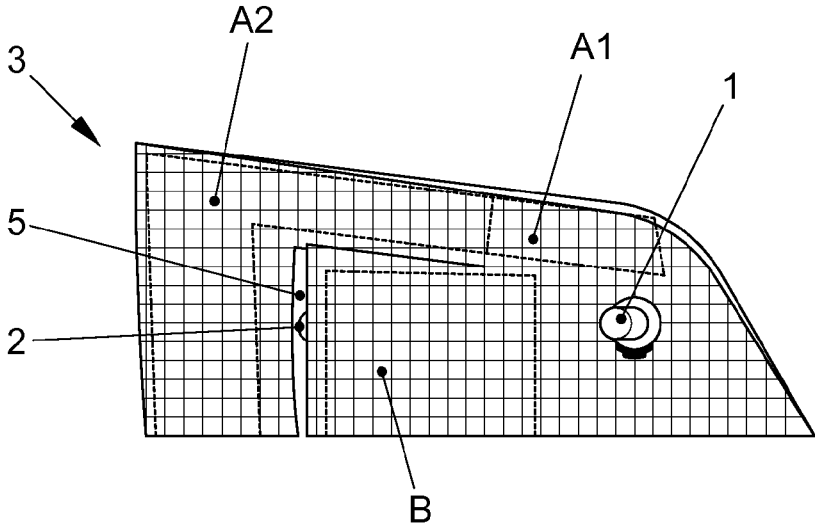
FIG. 2 shows a further perspective view of the exemplary embodiment of the light.
Figure 3:
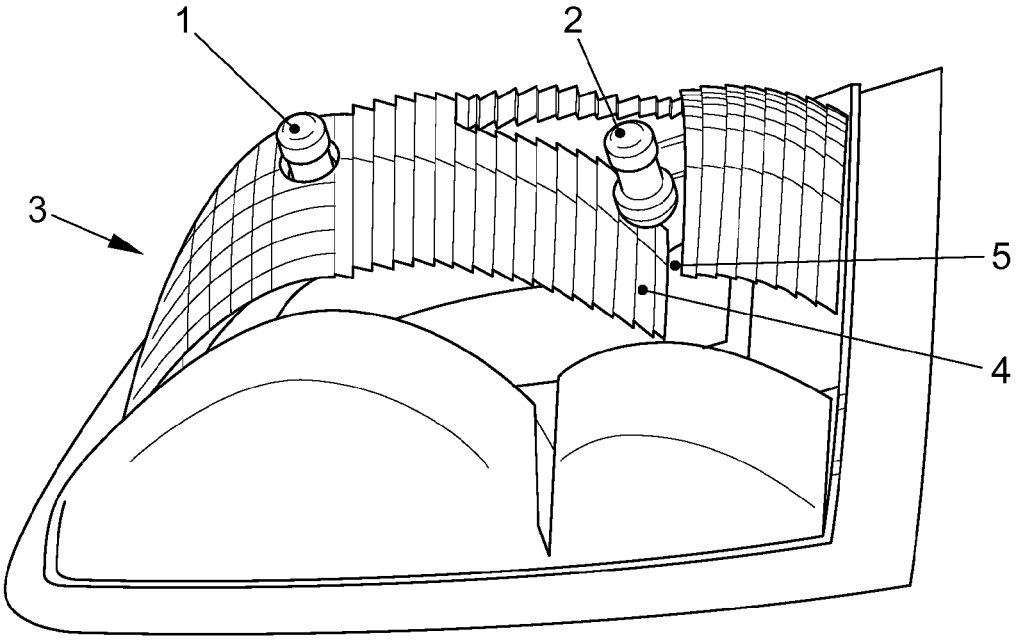
FIG. 3 shows a perspective view of the exemplary embodiment of the light from the backside.

Referring to FIGS. 1 to 3, at first the basic structure of the light is described. The light of the exemplary embodiment shown is a tail light. The directions given, such as horizontal, vertical and lateral, in the following refer to the mounting of the light in a vehicle.

The light comprises a light source 1. Here, this may be a light source 1 known in prior art, that is as punctiform as possible. Relative to the light emission direction of the light the light source 1 is arranged in front of a reflector 3. Generally, for this purpose the reflector 3 has an opening through which a fixture for the light source 1 may pass. However, the position at which the light emission is created is located in front of the reflector in regard to the light emission direction of the light. In doing so it is of course possible that reflector regions are formed laterally alongside of the light source 1 which extend as far as ahead of the light source. However, on an axis running in parallel with the light emission direction of the light through the light source 1 the light source is located in front of reflector face regions which are adjacent to the light source 1.

The reflector 3 is characterized in that it has an opening 5. In this case, the opening 5 is not an opening through which a fixture of a light source passes through so that the light source may be accommodated in the reflector. Rather, the light comprises a second light source 2 that, relative to the light emission direction of the light, is arranged behind a part 4 of the reflector 3. The light emitted by the light source 2 passes through this opening 5 and impinges on a region of the reflector face of the reflector 3 and is reflected there. In this way, the part 4 of the reflector 3 serves to mask the light source 2 during an observation of the light from the outside. However, the opening 5 formed by the part 4 allows that the light emitted by the light source 2 impinges on reflector faces of the reflector 3 and becomes a part of the light emission of the light.

The arrangement of the second light source 2 behind the part 4 of the reflector 3 is to be understood such that a ray of light emitted by the second light source 2 in the direction of the light emission direction L (FIG. 4) of the light cannot pass the part 4 of the reflector 3 unimpeded, but is absorbed or scattered at the backside of the part 4 of the reflector 3. Furthermore, it may be provided for that the rays of light emitted by the second light source 2, which pass through the opening 5, either are absorbed or are reflected by a reflector face of the reflector 3. In this case, under no angle a direct view onto the second light source 2 is possible from the outside, so that this in each instance remains invisible from the outside for the viewer.

As shown in FIG. 2, the reflector 3 has different regions comprising reflector faces. These regions are denoted A1, A2 and B in FIG. 2. The remaining faces of the reflector 3 are not effective with regard to light engineering. For example, the light of the light sources 1 and 2 impinging on these remaining faces may be absorbed. Reflector 3 is formed continuous, in particular in one piece.

The light emitted by the first light source 1 impinges on the reflector faces A1 and B, the light emitted by the second light source 2 impinges on the reflector face A2.

Furthermore, the rays of light reflected at the reflector face regions A1 and A2 form a first luminescent face and the rays of light reflected by the reflector face region B form a second luminescent face, as will be described later. The two luminescent faces are characterized in that they are discontinuous.

A so-called free form reflector constitutes reflector 3. In doing so, the free form reflector faces are adapted to the arrangement of the light sources 1 and 2 such that the free form reflector faces create a parallel or approximately parallel light beam. With this in mind, the light sources 1 and 2 are thus arranged at focal points of the free form reflector faces.

Figure 4:
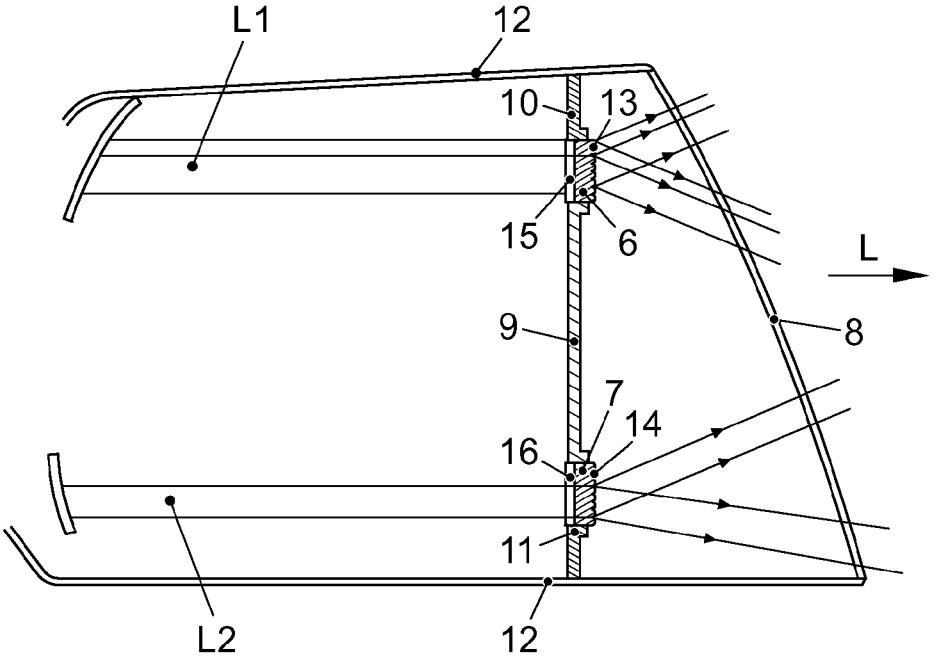
FIG. 4 shows a cross section of the exemplary embodiment of the light.

Referring to FIG. 4 the further beam path of the light beam created by the reflector 3 is described:

The regions A1 and A2 of the reflector face of the reflector 3 create a first coherent light beam L1. The region B of the reflector face of the reflector 3 creates a second coherent light beam L2, which is separate from the light beam L1. The first light beam L1 impinges on a light pane formed as an intermediate light pane 6. On the side facing towards light source 1 the intermediate light pane 6 has light dispersing elements 15, and light dispersing elements 13 on the side facing away from the light source 1, i.e. on the side visible from the outside. The light is deflected in vertical and horizontal directions by these light dispersing elements 15 and 13 and a first luminescent face 17 is created, as will be described later.

The second light beam L2 impinges on a second intermediate light pane 7. In the present exemplary embodiment the intermediate light pane 7, like the intermediate light pane 6, has light dispersing elements 16 on the side facing towards the light source 1 and light dispersing elements 14 on the side facing away form the light source 1. In doing so, the light dispersing elements 13 and 14 of the intermediate light panes 6 and 7, which are arranged on the side facing away from the light source 1, may be formed identically. A second luminescent face is formed by the intermediate light pane 7, which is characterized in that it is discontinuous with respect to the first luminescent face, which is formed at the intermediate light pane 6. Thus, two separate luminescent faces are created by a single continuous reflector 3.

The light is provided within a housing 12 that is completed by a completion pane 8 towards the outside. The completion pane 8 is formed using the visual effect of clear glass, so that, with respect to their direction, the rays of light emanating from the intermediate light panes 6 and 7 essentially are not affected by the completion pane 8.

The intermediate light panes 6 and 7 are arranged perpendicular to the light emission direction L of the light. In this plane perpendicular to the direction L a mask 9 is located between the two intermediate light panes 6 and 7, further, above and below the intermediate light panes 6 and 7 the masks 10 and 11 are located. In doing so, mask 9 shields the first light source 1 such that a direct view onto the light source 1 from the outside is prevented. Further, the masks 10 and 11 prevent that it is possible to look into the light laterally from the outside. Thus, only visible from the outside are the light dispersing elements 13 and 14 of the sides of the intermediate light panes 6 and 7 facing away from the light source 1, which form the two luminescent faces. In doing so, the first light source 1 is shielded by the mask 9 such that it is not visible from the outside, and the second light source 2 is shielded by the part 4 of the reflector 3 such that it as well is not visible from the outside.

As shown in FIG. 1, in its cross section the light may be completed by the masks 9, 10 and 11, as well as the intermediate light panes 6 and 7. However, the masks 9 to 11, in particular mask 9, could also be provided separate from the intermediate light panes 6 and 7. In this case, the intermediate light panes 6 and 7 could be formed by a single intermediate light pane, wherein the light dispersing elements 13 to 16 only are arranged in the region of the desired luminescent faces.

Figure 5:
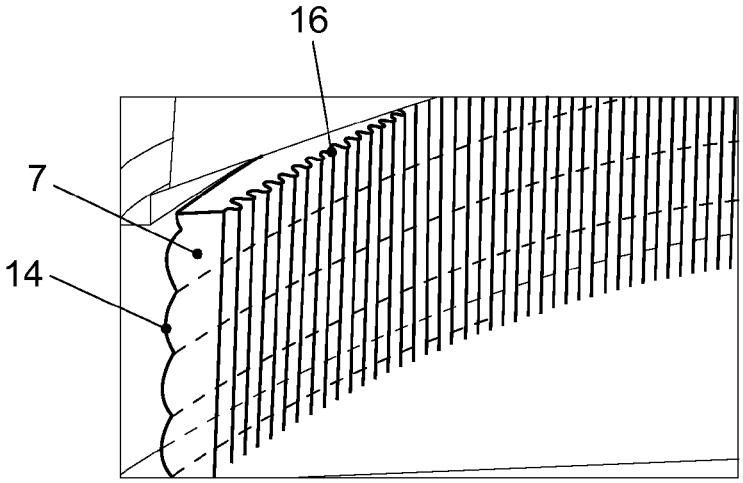
FIG. 5 shows a detail of the exemplary embodiment of the light.

FIG. 5 shows a detail of the intermediate light pane 7. The intermediate light pane 6 is formed correspondingly. On the side visible from the outside the intermediate light pane 7 has light dispersing elements 14, which extend in horizontal direction. These are partial cylinders. The curvature of the surface may be circular or may have another convex curved shape. The parallel incident light beam is dispersed in vertical direction by these horizontally extending light dispersing elements 14. However, the shape of the light dispersing elements 14 in particular follows the design that the light is meant to receive, since these light dispersing elements 14 are visible from the outside.

Arranged on the inside of the intermediate light pane 7 are light dispersing elements 16, which extend in vertical direction. In this case, too, these are partial cylinders whose curvature, however, differs from the curvature of the partial cylinders of the light dispersing elements 14. The curvature of the light dispersing elements 16 is larger, so that more light dispersing elements 16 are arranged on the intermediate light pane 7 per unit of length than light dispersing elements 14. The light dispersing elements 16 cause a deflection of the parallel incident light beam in horizontal direction. Therefore, they essentially determine from which angles the light is visible by other traffic participants. Aspects of design do not have to be considered during the shaping of the light dispersing elements 16, since these essentially are not visible from the outside. They may be chosen such that the optical requirements for the light are satisfied.

REFERENCE NUMERALS

1 first light source
2 second light source
3 reflector
4 part of the reflector
5 opening
6 intermediate light pane
7 intermediate light pane
8 completion pane
9 mask
10 mask
11 mask
12 housing
13 light dispersing elements
14 light dispersing elements
15 light dispersing elements
16 light dispersing elements

What is claimed is:

1. A light for a vehicle, the light configured to emit light in a light emission direction and comprising:

a single continuous reflector defining a continuous reflector face comprising multiple reflector face regions and an opening formed in the continuous reflector face, a first light source arranged such that the light emission thereof is reflected by a front side of a first region of the reflector face of the reflector, and a second light source arranged behind the first region of the reflector face in a concealed manner relative to the light emission direction of the light such that at least a portion of the light emission of the second light source cannot pass unimpeded through the reflector in the light emission direction of the light, but rather, in the following order, passes through the opening, impinges on a front side of a second region of the reflector face of the reflector, reflects off the front side of the second region of the reflector face, and propagates along the light emission direction of the light, wherein the first region of the reflector face is located generally between the first light source and the second region of the reflector face, wherein from a front view of the reflector face, the opening extends only partially across a height of the reflector face in along a virtual direction, and wherein the first region of the reflector face that reflects light emission of the first light source forms a continuous connection with the second region of the reflector face that reflects the light emission of the second light source via a reflector face portion located vertically adjacent the opening and extending laterally across a lateral width of the opening.

2. The light according to claim 1, wherein the reflector has an indentation, a part of the reflector formed by the indentation is curved forward in the light emission direction of the light and the second light source is arranged behind the forward curved part of the reflector.

3. The light according to claim 2, wherein the forward curved part of the reflector is formed in the form of a shovel.

4. The light according to claim 2, wherein the direct view onto the second light source from the outside is prevented by the forward curved part of the reflector.

5. The light according to claim 1, wherein the first light source is arranged at the focal point of the regions of the reflector face of the reflector which reflect the light emission of the first light source and the second light source is arranged at the focal point of the regions of the reflector face of the reflector which reflect the light emission of the second light source.

6. The light according to claim 1, wherein at least one light pane is provided onto which the light reflected by the reflector faces impinges and at which at least two discontinuous luminescent faces are formed.

7. The light according to claim 1, wherein the at least one light pane comprises light dispersing elements on the side facing towards the first light source as well as on the side facing away from the first light source.

8. The light according to claim 7, wherein the light dispersing elements extend in horizontal direction on the side facing away from the first light source.

9. The light according to claim 8, wherein the light dispersing elements on the side facing away from the first light source are horizontally aligned partial cylinders.

10. The light according to claim 7, wherein the light dispersing elements extend in vertical direction on the side facing towards the first light source.

11. The light according to claim 7, wherein the at least one light pane or the light dispersing elements of the light pane only is/are arranged in the region of the luminescent faces of the light.

12. The light according to claim 1, wherein the first light source is shielded by a mask that prevents a direct view onto the first light source from the outside.

13. The light according to claim 1, wherein the light has a housing which is completed by a completion pane in the outlet direction of the light, and the at least one light pane is arranged inside the housing.

14. A vehicle comprising:

a light configured to emit light in a light emission direction and comprising:

a single continuous reflector defining a continuous reflector face comprising multiple reflector face regions and an opening formed in the continuous reflector face, a first light source arranged such that the light emission thereof is reflected by a front side of a first region of the reflector face of the reflector, and a second light source arranged behind the first region of the reflector face in a concealed manner relative to the light emission direction of the light such that at least a portion of the light emission of the second light source cannot pass unimpeded through the reflector in the light emission direction of the light, but rather, in the following order, passes through the opening, impinges on a front side of a second region of the reflector face of the reflector, reflects off the front side of the second region of the reflector face, and propagates along the light emission direction of the light, wherein the first region of the reflector face is located generally between the first light source and the second region of the reflector face, wherein from a front view of the reflector face, the opening extends only partially across a height of the reflector face in along a virtual direction, and wherein the first region of the reflector face that reflects light emission of the first light source forms a continuous connection with the second region of the reflector face that reflects the light emission of the second light source via a reflector face portion located vertically adjacent the opening and extending laterally across a lateral width of the opening.

15. The vehicle according to claim 14, wherein the reflector has an indentation, a part of the reflector formed by the indentation is curved forward in the light emission direction of the light and the second light source is arranged behind the forward curved part of the reflector.

16. The vehicle according to claim 15, wherein the forward curved part of the reflector is formed in the form of a shovel.

17. The vehicle according to claim 15, wherein the direct view onto the second light source from the outside is prevented by the forward curved part of the reflector.

18. The vehicle according to claim 15, wherein the first light source is arranged at the focal point of the regions of the reflector face of the reflector which reflect the light emission of the first light source and the second light source is arranged at the focal point of the regions of the reflector face of the reflector which reflect the light emission of the second light source.

19. The vehicle according to claim 15, wherein at least one light pane is provided onto which the light reflected by the reflector faces impinges and at which at least two discontinuous luminescent faces are formed.

20. The vehicle according to claim 15, wherein the at least one light pane comprises light dispersing elements on the side facing towards the first light source as well as on the side facing away from the first light source.

21. A light for a vehicle, comprising:

a continuous reflector comprising multiple reflector face regions, and a first light source arranged such that the light emission thereof is reflected by a front side of a first reflector face region of the reflector, the front side of the first reflector face region facing forward toward an output surface of the light visible from outside the vehicle, and a second light source arranged behind the first reflector face region and relative to the opening between the first and second reflector face regions such that at least a portion of the light emitted by the second light source passes through an opening in the reflector, off a front side of the second reflector face region, and toward the output surface of the light visible from outside the vehicle, wherein the first reflector face region is located generally between the first light source the second reflector face region, wherein from a front view of the reflector face, the opening extends only partially across a height of the reflector face in along a virtual direction, and wherein the first region of the reflector face that reflects light emission of the first light source forms a continuous connection with the second region of the reflector face that reflects the light emission of the second light source via a reflector face portion located vertically adjacent the opening and extending laterally across a lateral width of the opening.

* * * * *